United States Patent [19]

Sassmannshausen

[11] 4,277,821

[45] Jul. 7, 1981

[54] LAMP

[76] Inventor: Knut O. Sassmannshausen, Rothenbach, D-6580 Idar-Oberstein, Fed. Rep. of Germany

[21] Appl. No.: 18,931

[22] Filed: Mar. 9, 1979

Related U.S. Application Data

[63] Continuation-in-part of Ser. No. 808,728, Jun. 21, 1977, Pat. No. 4,143,412, and Ser. No. 940,574, Sep. 8, 1978, abandoned.

[30] Foreign Application Priority Data

| | | | |
|---|---|---|---|
| Jun. 24, 1976 | [DE] | Fed. Rep. of Germany | 2628243 |
| Oct. 22, 1976 | [DE] | Fed. Rep. of Germany | 2647889 |
| Sep. 12, 1977 | [IE] | Ireland | 1883/77 |

[51] Int. Cl.[3] ..... F21V 7/00

[52] U.S. Cl. ..... 362/346; 362/299; 362/350

[58] Field of Search ..... 362/297, 299, 304, 305, 362/309, 327–329, 339, 340, 346–348, 350

[56] References Cited

U.S. PATENT DOCUMENTS

| | | | |
|---|---|---|---|
| 1,260,387 | 3/1918 | Johanson | 362/348 |
| 1,394,934 | 10/1921 | O'Neil | 362/297 |
| 1,915,842 | 6/1933 | Winkler | 362/348 |
| 1,977,673 | 10/1934 | Exelmans | 362/329 |
| 2,143,435 | 1/1939 | Dietrich | 362/309 |
| 2,174,937 | 10/1939 | Dietz | 362/346 |
| 2,383,042 | 8/1945 | Cavert | 362/348 |
| 3,267,278 | 8/1966 | Doolittle | 362/339 |
| 3,428,800 | 2/1969 | Levin et al. | 362/309 |
| 3,532,876 | 10/1970 | Müller et al. | 362/339 |

*Primary Examiner*—Peter A. Nelson

*Attorney, Agent, or Firm*—Herbert L. Lerner

[57] ABSTRACT

A lamp having a main and an assistant reflector disposed mutually coaxially and having different parameters and focal regions includes a light source disposed in the focal region of the assistant reflector so that the main reflector emits a hollow conical light beam, and means associated with the assistant reflector for diverting light of the assistant reflector into a solidly conical light beam, the means being of such dimensions that the aperture angle of the solidly conical light beam of the assistant reflector and the aperture angle of the hollow conical light beam of the main reflector correspond to such an extent that both the hollow conical and solidly conical light beams exhibit at least one of the characteristics of supplementing and overlapping one another.

42 Claims, 28 Drawing Figures

FIG.22a
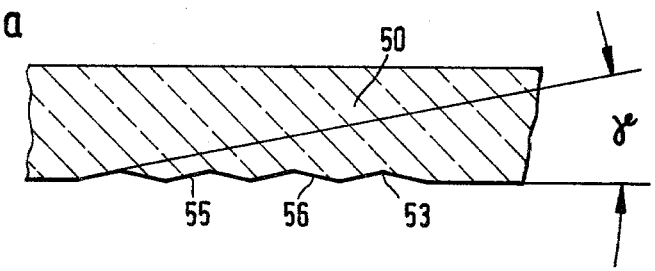
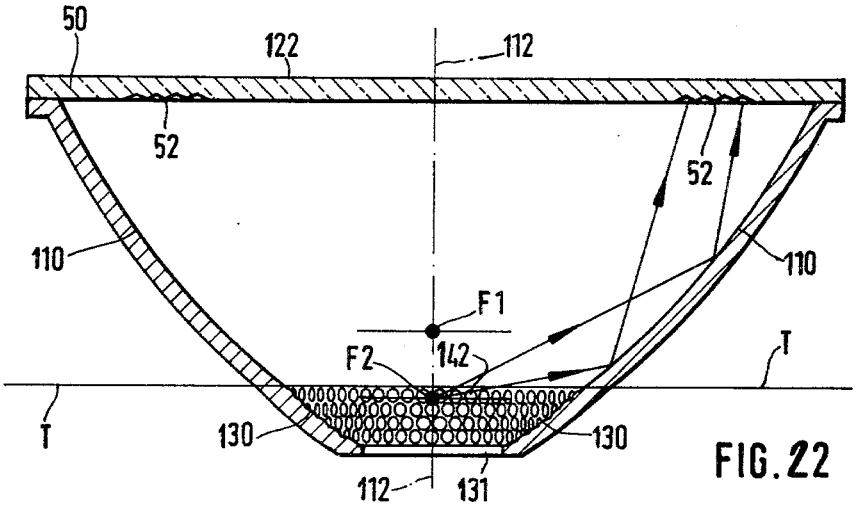
FIG.22
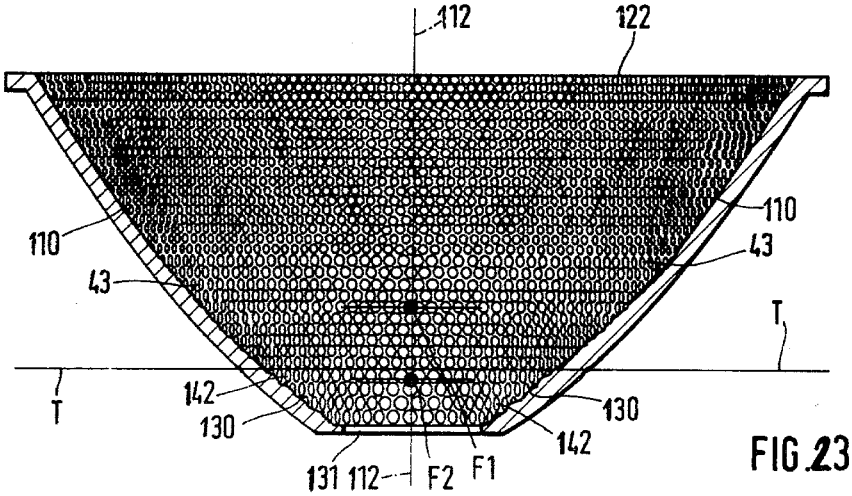
FIG.23

LAMP

CROSS-REFERENCE TO RELATED APPLICATIONS

This application is a continuation-in-part application of our formerly copending applications entitled "LIGHTING FIXTURE SUCH AS A TAIL, WARNING OR SIGNAL LIGHT, ESPECIALLY," Ser. No. 808,728, filed June 21, 1977, which has matured into U.S. Pat. No. 4,143,412; and "LAMP," Ser. No. 940,574, filed Sept. 8, 1978, and now abandoned.

The invention relates to a lamp or flashlight (especially a tail light, safety lamp or signal lamp) having a light source, a main reflector and an assistant or auxiliary reflector disposed coaxially to one another and having different parameters and different focal regions.

Such a lamp has become known heretofore from French Pat. No. 747 832 to Fraise. In this heretofore known lamp, at least two separate light sources are provided and selectively switched on; these separate light sources selectively produce a parallel bright light such as a driving light or, on a weakly diffused, illuminated background, a ring-shaped light beam which forms such a sharp contrast with respect to the background that the illumination is very ill-suited for identifying objects. This heretofore known lamp is especially inadequate for meeting the hereinafter explained requirements of signal lamps or the like.

The light beam of a signal lamp or the like should (for example, according to German code or regulations) at least illuminate an angular spread or angle range having a square cross section which extends 10° toward the right-hand side and 10° toward the left-hand side of the direction of travel. In order to attain such an aperture angle of, respectively, 20° in vertical and in horizontal directions, the aperture angle of a light beam axially symmetrical to the travel direction must be at least about 28°.

In the past, one proceeded from the assumption that the light intensity (measured in candle power) should be as uniform as possible in this light beam. If the energy available for operation of the lamp is limited, however, which is the case, for example, for bicycles or for parking lights of motor vehicles (which also ought not to drain the battery when parking for a long time), it is thus more expedient to distribute the light intensities non-uniformly following a general pattern.

This is explained by means of an example. A bicyclist travels on a two-lane street or road having a width of 8 m and is located a distance of 1 m from the side of the road. The difference in velocity between the bicyclist and a passenger car following behind him is generally very great, especially along straight stretches of a road if, for example, the bicyclist is traveling 15 km per hour and the motor vehicle 100 km per hour. Because of this great velocity difference, the bicyclist is generally overtaken more rapidly by the motor vehicle following behind him than is a motor vehicle preceding such a following motor vehicle, so that actually the rear or tail light of the bicycle must be visible better and farther than that of a motor vehicle. Since, however, less energy is available to the bicyclist than to a motor vehicle, the latter has been provided with a stronger i.e. more powerful, tail light in accordance with the prior state of the art. It should be taken into consideration that the motor vehicle approaching from behind the bicycle often travels so that the driver of the motor vehicle is located in the middle of the road. In this case, the line of sight from the eye of the driver of the following motor vehicle to the tail light of the bicycle, with the direction of travel, includes an angle referred to hereinafter as the "viewing angle." This viewing angle increases as the motor vehicle overtakes the bicycle. In order for the tail light of the bicycle to be visible in the respective viewing angle, (A) in an axially symmetrical aperture angle of the tail light which is twice as large as the respective viewing angle, (B) the intensity of the lighting power must be adequate for perceiving the light or lamp.

For example, if the tail light of the bicycle is visible to the driver of the approaching motor vehicle up to a distance of 170 m within a viewing angle of up to 2°, the axially symmetrical aperture angle of the light beam that remains perceivable within this range of distance must thus be 4°. In the range of distance from 170 m to 70 m, the viewing angle is from 2° to 5°, so that the axially symmetrical aperture angle of the light beam visible in this range of distance must be from 4° to 10°. In a range of distance from 70 m to 17 m, the viewing angle is from 5° to 10°, so that the axially symmetrical aperture angle of the light beam visible in this range of distance must be from 10° to 20°.

Since the visibility of a conventional lamp decreases with the distance therefrom, however, the lighting power or light intensity of the beam must correspondingly increase from the outside toward the inside thereof in order to ensure uniform visibility of the lamp or light independently of the distance. For example, the range of the light beam of the lamp or light, which is visible to the following motor vehicle at a distance of 170 m and more, should shine or illuminate more intensely than the range which the eye of the approaching driver meets as he approaches, for example, to 17 m.

Naturally, other factors are involved, such as, for example, the curvature of the road, varying road widths, varying traveling conditions, if on-coming or two-way traffic exists or not, and the like. Even after taking these factors into consideration, it remains advantageous to construct a lamp so that it, in addition to a basic brightness which ought not to be diminished anywhere within the light beam, additionally possesses a brightness increasing toward the axis thereof.

In order to increase the brightness sharply especially in the viewing directions necessary for great distances, only relatively slight amounts of light are required, because the closer the viewing direction is to the axis, the smaller is the solid angle to be illuminated and the lower is the amount of light necessary for increasing the lighting power or light intensity.

The foregoing remarks may be summarized to the effect that, with regard to a signal lamp, it is an object of the invention to provide such a lamp having low energy consumption, (a) which is clearly visible by other travelers on the road even at a great distance and (b) which remains visible by these other travelers on the road even when they approach outside or beyond the axis of the lamp or light.

This objective is attained with a lamp or lighting fixture initially developed by me and comprising a concave relector having a given focal region and an axis, and means at least partly disposed in the focal region for supplying a source of light thereat reflectible at maximal intensity by the concave reflector generally in direction of the axis thereof and relectible at decreasing intensity in directions extending from the light source at an increasing angle $\beta$ relative to the direction of the axis, so that (a) at $\beta=1°$, the light intensity is at least 200%, (b) at $\beta=2.5°$, the light intensity is at least 150%, and (c) at $\beta=5°$, the light intensity is at least 120% of the light intensity at $\beta=10°$, the concave reflector having a reflective surface formed with a multiplicity of reflecting curved surface portions, the mean height of all thereof being equal to from 3% to 12% of the mean smallest base diameter of all of the reflecting curved surface portions.

These values should obviously not change abruptly, but rather, should continuously merge increasingly into one another. It has been found by me, however, that the basic brightness of the aforedescribed lamp or lighting fixture could be improved. With respect to the aforedescribed lamp or lighting fixture, I sought as a further object to provide a lamp wherein the light in a range of 10° (viewing angle) to the axis up to at least 15° (viewing angle) to the axis is intensified to such an extent that the light distribution curve in this range has a bulge. In this manner, the visibility of the lamp in directions deviating from the axial direction should be sharply increased.

With the foregoing and other objects in view, there is provided, in accordance with the improved invention of the instant application, a lamp having a main and an assistant reflector disposed mutually coaxially and having different parameters and focal regions, comprising a light source disposed in the focal region of the assistant reflector so that the main reflector emits a hollow conical light beam, and means associated with the assistant reflector for diverting light of the assistant reflector into a solidly conical light beam, the means being of such dimensions that the aperture angle of the solidly conical light beam of the assistant reflector and the aperture angle of the hollow conical light beam of the main reflector correspond to such an extent that both the hollow conical and solidly conical light beams exhibit at least one of the characteristics of supplementation and overlapping one another.

This lamp according to the invention has a light distribution curve composed of two parts:

(a) The range of high lighting power or light intensities located near the axis is formed of the solidly conical light beam radiating from the assistant reflector; this range corresponds to the light distribution curve of my aforementioned copending application.

(b) The bulges on both sides of the light distribution curve, respectively, between about 10° (viewing angle) to the axis, are formed by the ring-shaped (hollow conical) light beam and/or by overlapping of both light beams.

In accordance with another feature of the invention, the means for diverting the light of the assistant reflector, comprise protuberances in the form of a plurality of at least one type of structural features selected from the group thereof consisting of bulges and depressions formed in the reflecting surface of the assistant reflector, all of the protuberances having a mean height that is 3% to 20% of a mean smallest base diameter of all of the protuberances, a maximal spacing between two points of the light source being at least twice as large as the mean height of all of the protuberances.

In accordance with a further feature of the invention and instead of this special construction of the reflecting surface of the assistant reflector or in addition to this construction of the reflecting surface of the assistant reflector, the means for diverting the light of the assistant reflector comprise flutes formed in a cover plate located at a light outlet end of the reflectors, the flutes being in a region of the cover plate through which the light of the assistant reflector passes.

If the light source is located in the focal region of the assistant reflector, a result thereof is that the main reflector emits the ring-shaped (hollow conical) light beam which alone or primarily produces the bulges of the light distribution curve. Should these bulges be shifted closer to the axis of the lamp or should the amount of light contained in these bulges be directed fully parallel, not only is the aforementioned possibility provided advantageously, that the light source be disposed in the focal region of the assistant reflector, but rather, moreover, the further possibility is afforded of shifting this light source into the focal region of the main reflector.

In accordance with an added feature of the invention, the light source, on the one hand, and the reflectors, on the other hand, are adjustably shiftable in axial direction relative to one another so that the light source is selectively disposable in and between the focal regions, the main reflector, when the light source is in the focal region of the main reflector, emitting a substantially parallel main light beam.

A lamp with the given shifting or adjusting possibility is suited, for example, as a building-site lamp. The light distribution is variable so that this building-site lamp, selectively, (for example, on straight stretches of a limited access highway) is already visible from a great distance or (for example, on highways having many curves) is also visible from the side within a given viewing angle, depending upon whether the light source is set in the one or the other reflector. Also, it is possible, with such a lamp, as desired, to shine a parallel light beam into the distance or, when adjusting or setting the light source in the focal region of the assistant reflector, to illuminate a great area close at hand. Thus, the lamp according to the invention can be employed not only as a signal lamp, but also, for example, as a flashlight.

The light-diverting means associated with the assistant reflector, should not be dulled or deadened because, when the surface thereof is dulled or deadened, it would scatter the light uncontrollably in all directions. In accordance with the invention, therefore, a conical light beam is produced and, for this reason, the light-diverting means (protuberances of the reflector or flutes of the cover plate) are formed with a smooth surface structure, in order to be able to beam the light into given angular spreads or ranges.

In accordance with an additional feature of the invention and, depending upon the disposition of the lamp, the aperture angle of the light beam is between 20° and 90° and, advantageously, between 30° and 60°.

Especially if the light source is selectively in the focal region of the assistant reflector or in the focal region of the main reflector, in accordance with yet another feature of the invention, the main reflector has a greater parameter than that of the assistant reflector so that, when setting the light source in the main reflector, light that is as exactly parallel as possible is produced thereby. The greater the parameter of a reflector is in relationship to the size of the light source, the more accurately can the light rays within the light beam be directed in parallel.

In accordance with yet a further feature of the invention, the coaxial reflectors have a light outlet opening, the main reflector of the two reflectors being located adjacent the light outlet opening. With such an arrangement, a very large part of the light rays emitted by the light source can be captured. This is especially advantageous for lamps which should illuminate, actively, objects or surfaces and with which, therefore, the reflectors and the light source are adjustable or shiftable relative to one another. This construction is suited especially well for flashlights and similar lamps used for illumination.

In order to be able to capture from the respective focal region as much light of the light source as possible, especially if it is selectively set in the one or the other focal region, and to bring the technical expense for the shifting of the light source down to an easily realizable value, there is provided, in accordance with another feature of the invention, that the main reflector has a greater parameter than that of the assistant reflector, the smaller assistant-reflector parameter being from 55% to 80% of the greater main-reflector parameter.

In accordance with a further feature of the invention, the main reflector has a greater parameter than that of the assistant reflector, the transition from the one reflector to the other reflector is of such construction that the spacing between both focal regions is 20% to 60%, advantageously 25% to 40%, and preferably 26% to 32% of the greater parameter.

In accordance with an added feature of the invention, and to achieve a good efficiency of the lamp, each of the focal regions is disposed in a surrounding space of the respective reflector associated therewith.

In accordance with an additional feature of the invention, and to achieve the best possible light distribution in the various light beams, a plane disposed through the focal region of the main reflector and perpendicularly to the lamp axis divides an angle stretching from the focal region of the main reflector to an outer and an inner edge of the main reflector so as to form an outer angle of at least 10°, advantageously at least 18° and preferably at least 25°, and an inner angle of at least 5°, advantageously at least 10° and preferably at least 15°. With this construction, the light beam produced by the main reflector has a very intense light.

In accordance with yet another feature of the invention and with regard to the assistant reflector, a plane disposed through the focal region of the assistant reflector and perpendicularly to the lamp axis divides an angle stretching from the focal region of the assistant reflector to an outer and an inner edge of the assistant reflector so as to form an outer angle of at least 0°, advantageously at least 2° and preferably at least 5°, and an inner angle of at least 10°, advantageously at least 18° and preferably at least 25°. With the assistant reflector, it is also advantageous if the inner angle of light acceptance through the reflector is considerably greater than the outer one whereas, for the main reflector, this relationship should be reversed if possible.

In accordance with yet a further feature of the invention, an outer edge of the assistant reflector and an inner edge of the main reflector are closely adjacent one another.

In accordance with an alternate feature of the invention, an outer edge of the assistant reflector and an inner edge of the main reflector substantially coincide one with the other.

The same applies, obviously, when the reflectors are disposed in other successions or sequences, since the outer edge of the main reflector and the inner edge of the assistant reflector must then lie as near one another as possible or must at best coincide.

In accordance with yet another feature of the invention, the protuberances are in the form of calottes and have a height which is 3.5% to 12%, and preferably 4% to 8%, of the smallest base diameter thereof, the greatest distance between two points of the light source being at least twice as great as the mean height of all the calottes.

In accordance with an alternate feature of the invention, the protuberances are in the form of rings and have a height which is 3.5% to 12%, and preferably 4% to 8%, of the width of a respective ring, the greatest distance between two points of the light source being at least twice as great as the mean height of all the rings.

In accordance with yet an added feature of the invention, and advantageous for various application, to provide means for homogenizing light associated with the main reflector. Such light-homogenizing means should not divert the light to such an extent that it experiences a critical or decisive change in direction, but rather, the light rays should be only very slightly influenced in order to intermix the respective light beam better and also to distribute the light uniformly within this light beam.

If the light source is disposed in the focal point of the assistant reflector, one can determine that the light reflected from the main reflector emerges in a relatively narrow ring-shaped region through the cover plate. It is advantageous and in accordance with the invention to furnish this ring-shaped region in the cover plate with the light-homogenizing means in the form, for example, of flutes, whereby the hollow-conical light beam of the light reflected by the main reflector is homogenized. If the light source, however, is disposed in the focal region F1 of the main reflector, then a great part of the parallel light rays emerges outside of the ring-shaped region of the cover plate which is provided with light-homogenizing means i.e. a greater part of the light rays are not reached by these homogenizing means in this position, whereby the sharp parallelism of the light beam is maintained and only a given part is homogenized.

In accordance with yet an additional feature of the invention, the flutes have a respective cross section in the form of an obtuse triangle having legs forming flanks of the respective flute, the legs including, with the surface of the cover plate, a flank angle of 3° to 20°, and advantageously of 5° to 12°.

In accordance with another feature of the invention, for other applications, the light homogenizing means comprise protuberances (bulges and/or depressions) disposed on the reflecting surface of the main reflector and having an extremely slight curvature i.e. a very large radius of curvature. Due to the extremely slight curvature, the light is not diverted from the main direction thereof, but rather, is homogenized somewhat only within the light beam. The main reflector could therefor also be provided with small facets; for example, the exactly parabolic shape of the reflectors could be broken down into a multiplicity of small reflecting surfaces or areas which are somewhat tangential to the mathematically ideal surface of the paraboloid. What is common to all of these light-homogenizing means is that they divert the light only quite negligibly. The surface structure should likewise be quite smooth i.e. highly polished, so that as little diffused light as possible occurs and the light beam according to the invention thus becomes lost.

In accordance with a further feature of the invention, a collecting lens is disposed in axial direction of the lamp in front of the light source for capturing and collecting light rays emitted from the light source and emerging directly in direction of a light outlet opening of the lamp and superimposing the thus collected light rays on a light beam collected and united by the main and the assistant reflectors. Such a collecting lens can be constructed, for example, as an integral part of the cover plate 50.

In accordance with an added feature of the invention, the collecting lens is constructed as a collecting lens of a lensend incandescent lamp, because thereby a considerably greater part of the light emerging from the light source can be captured and collected without the lens becoming so large that it disruptively affects the light beamed by the reflectors.

In accordance with an added feature of the invention, both the main and the assistant reflector are integral with one another.

In accordance with an additional feature of the invention, the lamp has a light intensity increasing with decreasing distance from the lamp axis so that part of the light beam which includes, with the lamp axis, an angle of 2°, has at least 2.1 times the light intensity of a part of the light beam which includes, with the lamp axis, an angle of 15°.

In accordance with an alternate feature of the invention, the lamp has a light intensity increasing with decreasing distance from the lamp axis so that part of the light beam which includes, with the lamp axis, an angle of 5°, has at least 1.8 times the light intensity of a part of the light beam which includes, with the lamp axis, an angle of 15°. A light distribution curve is thereby given which ensures that the light intensities, which have a given basic brightness as seen in the range of 15° from the axis, increase toward the axis so that travelers on the road which approach such a lamp on a straight road at high velocity are already warned while yet at a great distance therefrom.

If such a lamp is used as a flashlight, such as, for example, to illuminate the engine compartment of a bicycle during repairs, then the greater brightness occurring in axial direction can be diverted, for example, directly upon the trouble spot, such as, for example, a faulty spark plug, and nevertheless, adequate brightness is obtained in the surroundings of the axial region in order to perceive clearly all of the objects present in the engine compartment.

In accordance with a concomitant feature of the invention, the lamp has a light intensity increasing with decreasing distance from the lamp axis so that part of the light beam which includes, with the lamp axis, an angle of 2°, has at least four times the light intensity of a part of the light beam which includes, with the lamp axis, an angle of 15°.

In accordance with an alternate feature of the invention, the lamp has a light intensity increasing with decreasing distance from the lamp axis so that part of the light beam which includes, with the lamp axis, an angle of 5°, has at least twice the light intensity of a part of the light beam which includes, with the lamp axis, an angle of 15°.

Other features which are considered as characteristic for the invention are set forth in the appended claims.

Although the invention is illustrated and described herein as embodied in a lamp, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 12:
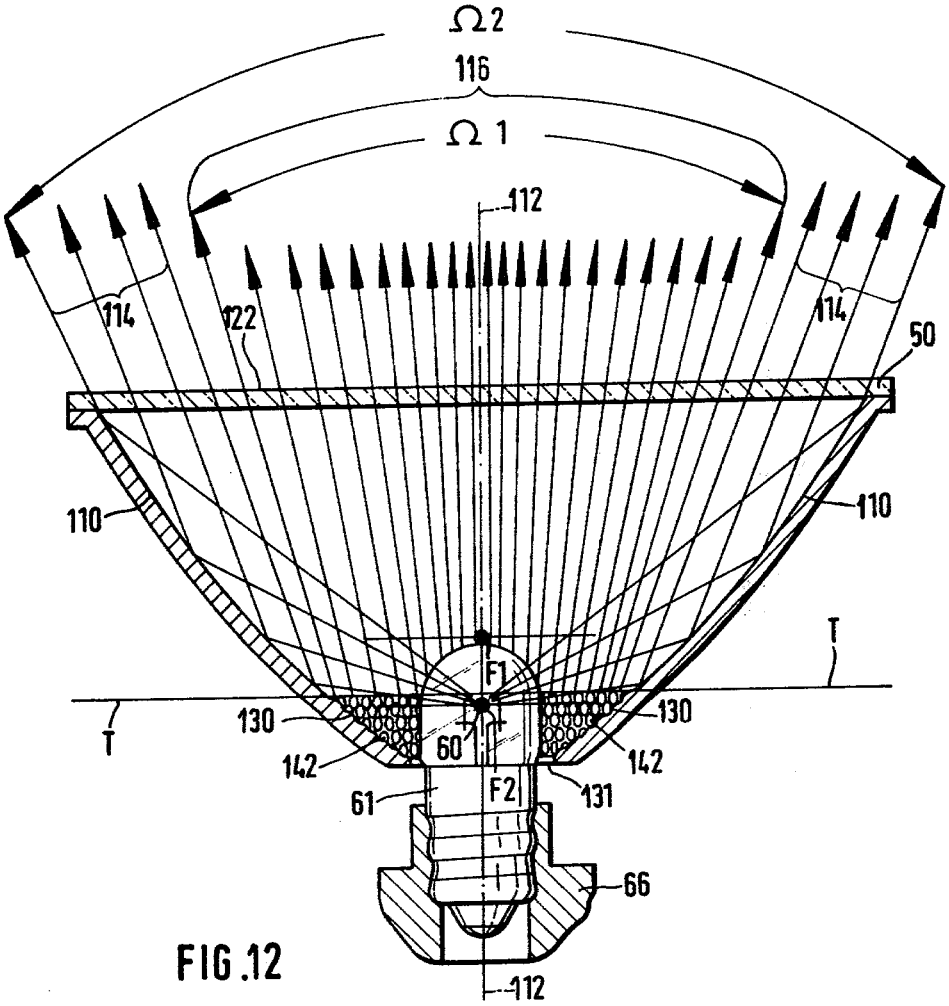
FIG. 12 is a diagrammatic longitudinal sectional view of the lamp embodiment emitting the light of which the light distribution curve is plotted in FIG. 11.
Figure 18A:
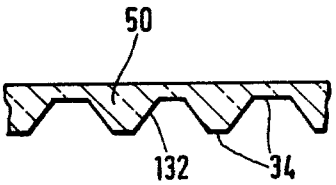
FIG. 18 is a view similar to that of FIG. 12 showing another embodiment of the lamp according to the invention.
Figure 18B:
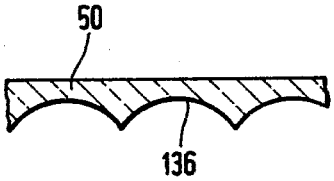
Figure 18:
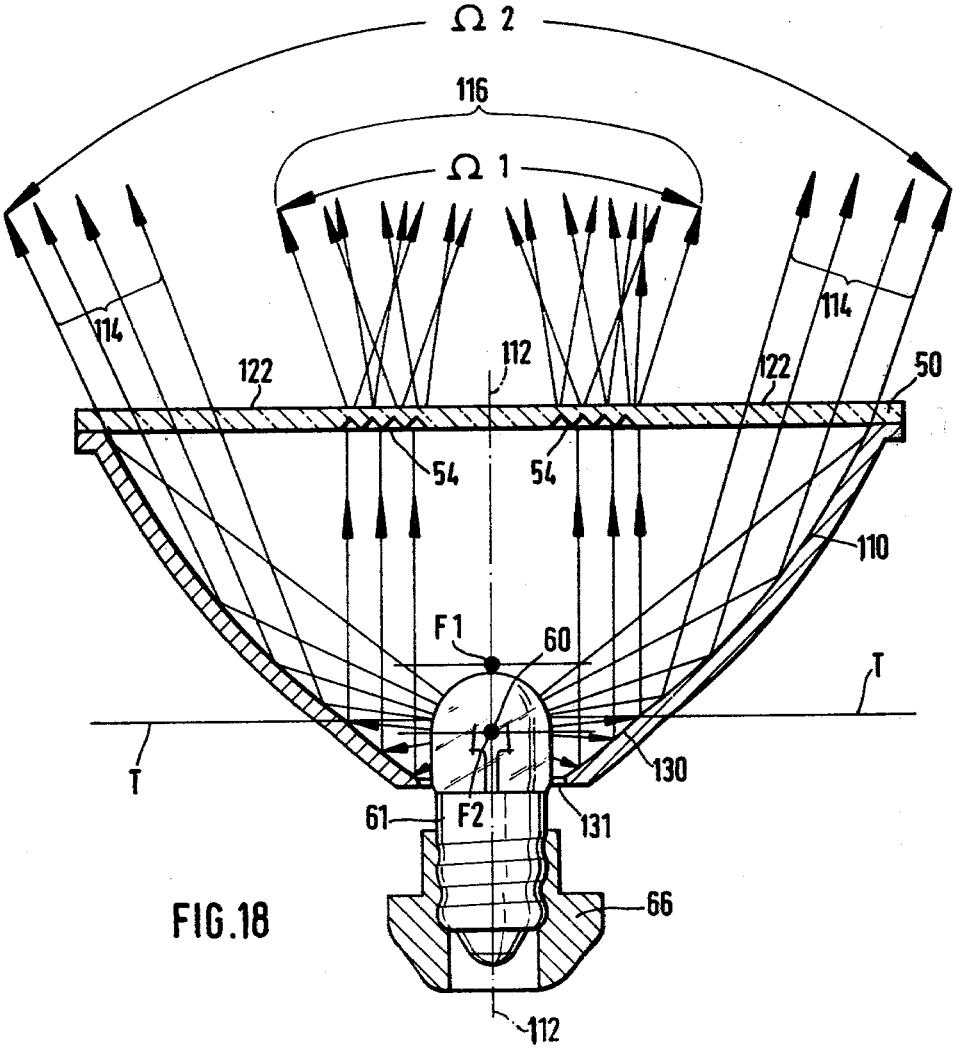
Figure 19:
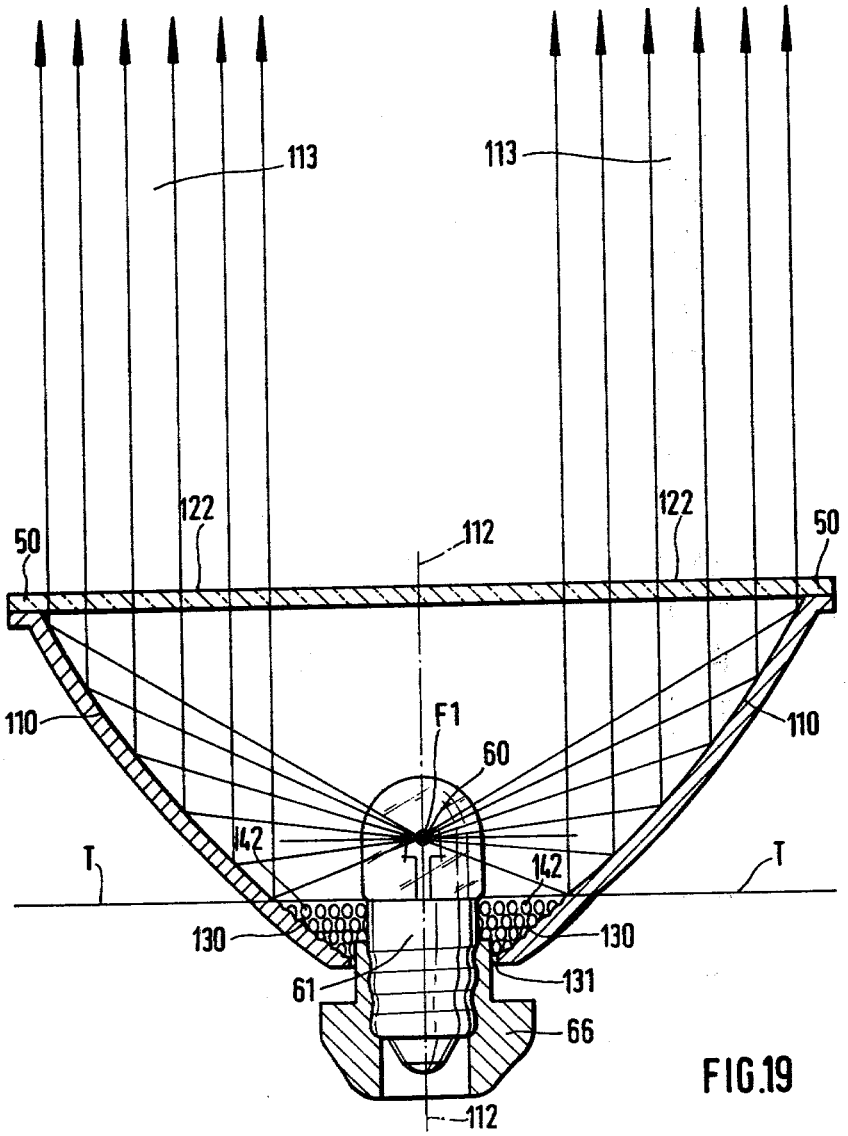
Figure 20:
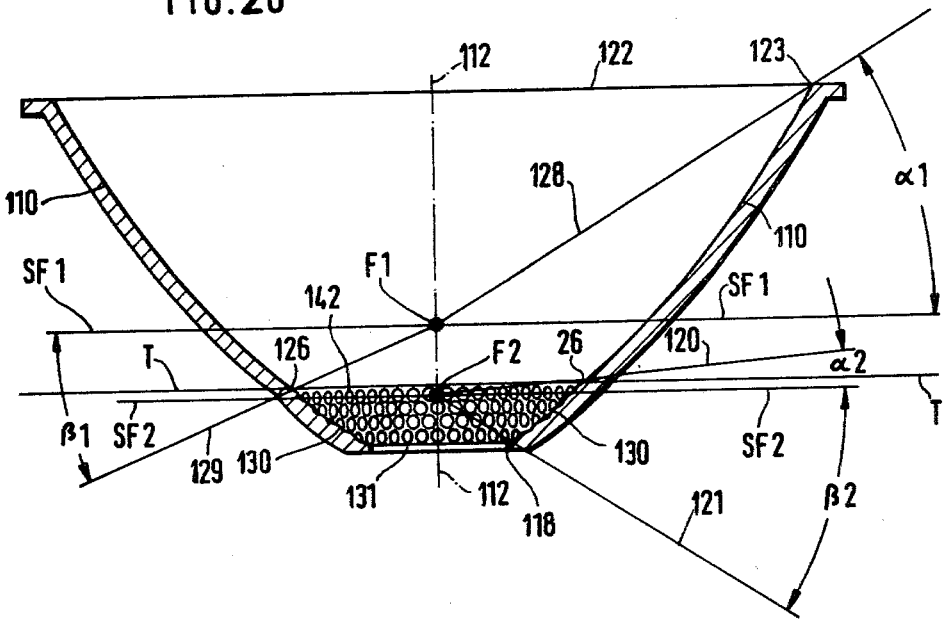
Figure 21:
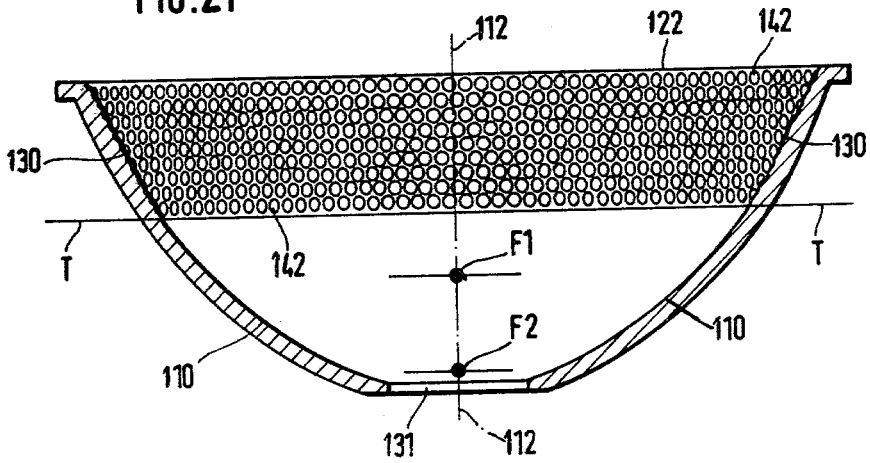
Figure 24:
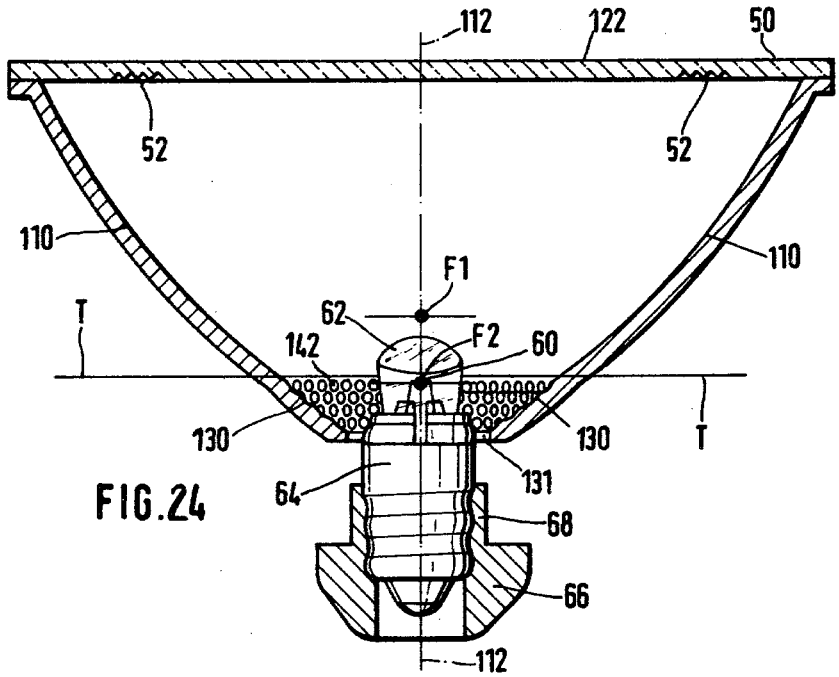
Figure 25:
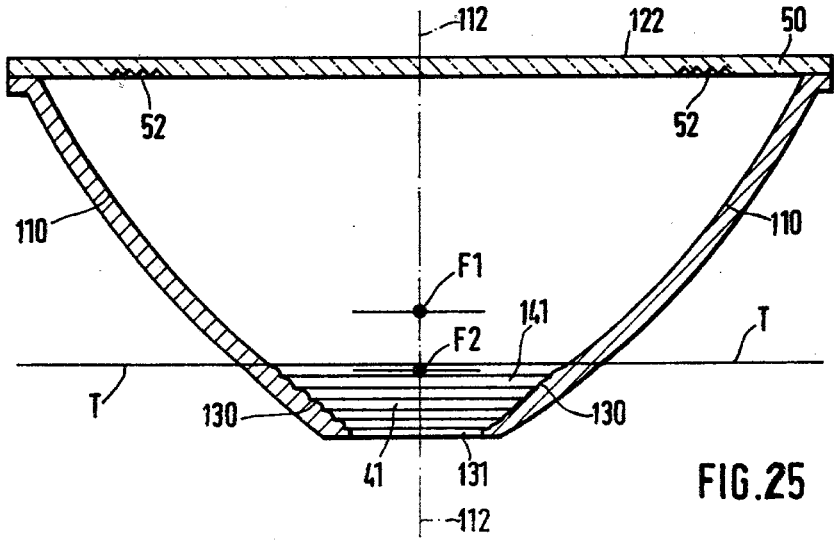

FIGS. 18*a* and 18*b* are enlarged fragmentary views of FIG. 12 showing different embodiments of the lamp cover plate thereof formed with circular flutes having truncated triangular and round or parabolic cross sections, respectively;

FIG. 19 is a view similar to those of FIGS. 12 and 18 showing yet another embodiment of the lamp according to the invention;

FIG. 20 is a fragmentary view of FIGS. 12 and 19 showing the reflector structure of the lamp in somewhat greater detail;

FIG. 21 is a view similar to that of FIG. 20 of another embodiment of the lamp reflector structure;

FIG. 22 is a view similar to those of FIGS. 12, 19 and 20 showing the lamp reflector structure together with a cover plate constructed in accordance with the invention;

FIG. 22*a* is an enlarged fragmentary view of FIG. 22 showing the flute formation in a part of the cover plate in clearer detail;

FIG. 23 is a view similar to that of FIG. 20 showing yet another embodiment of the lamp reflector structure;

FIG. 24 is a view similar to those of FIGS. 12 and 19 showing a lamp with a reflector structure and cover plate similar to those of FIG. 22; and FIG. 25 is a view similar to that of FIG. 22 of yet a further different embodiment of the reflector structure.

Figure 1:
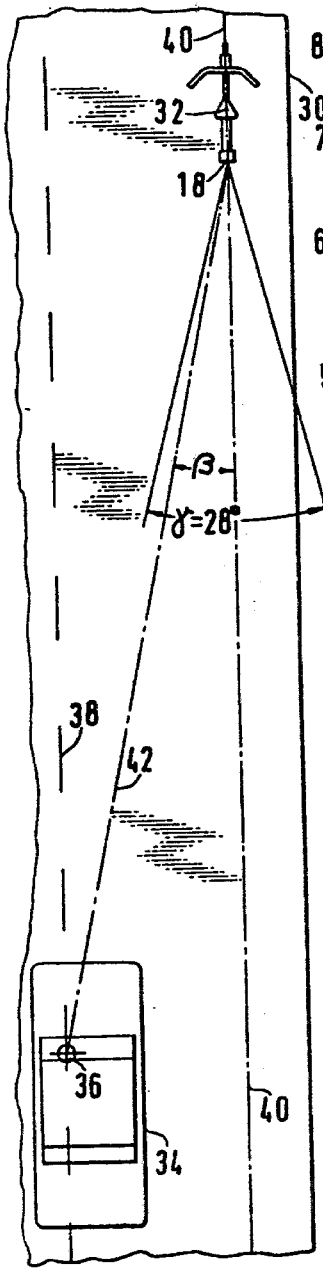
FIG. 1 is a diagrammatic plan view of a traffic situation wherein a motor vehicle is approaching a bicycle.

Referring now to the drawing and first, particularly, to FIG. 1 thereof,there is shown, close to the right-hand shoulder 30 of the road, a cyclist 32 with a tail light 18 which radiates light with an aperture angle $\gamma$ of 28°. The cyclist 32 is approached from the rear by a motor vehicle 34, the driver 36 of which moves along the center strip of the roadway 38. The distances of the motor vehicle 34 from the cyclist 32 are measured on the center strip 38 i.e. generally on the line of travel of the driver 36 of the motor vehicle 34. The viewing angle $\beta$ is the angle between the line of travel 40 of the cyclist 32 and the viewing direction 42 of the driver 36 onto the tail light 18.

Figure 2:
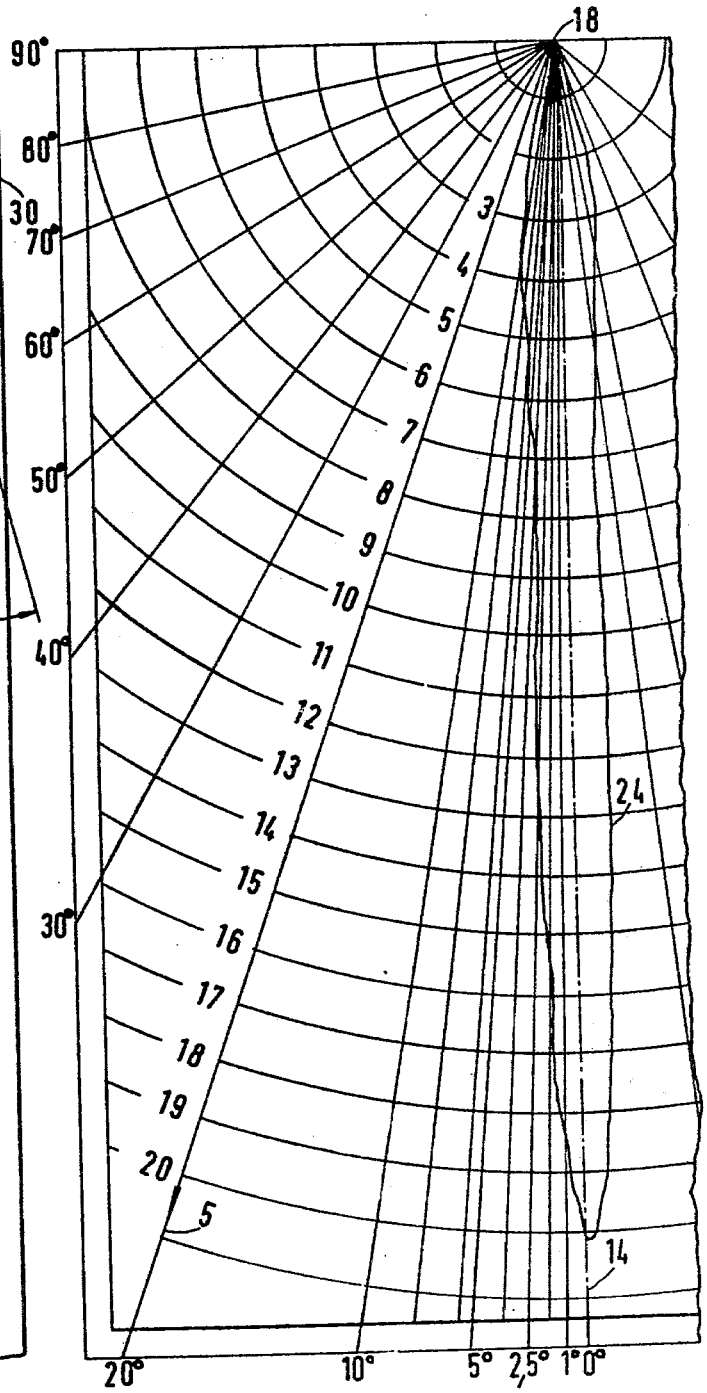
FIG. 2 is a plot diagram showing distribution of light intensity over viewing directions, in accordance with the invention.

In order that this tail light 18 be visible to the driver 36 from all reasonably considered distances, it has the light distribution curve shown in FIG. 2, in accordance with the invention.

The lighting fixture 18 radiates or directs its beam substantially in the direction of the reflector axis 14. The angles of the viewing direction to the lighting fixture 18 are measured from the reflector axis 14 (viewing direction 0°) and given in degrees at the margin of the graph of FIG. 2. Around the lighting fixture 18 in FIG. 2 concentric circles are drawn having a distance therebetween corresponding to 1 candela (Note: The values of the light intensity in candelas at each of the distances from the lighting fixture 18 represented by the concentric circles are indicated on the line 5). The curve 24 indicates the dependence upon the viewing angle $\beta$ of the light intensity in candelas, measured on a lighting fixture 18 according to the invention. It is apparent that the light intensity, for a viewing direction of $\beta=14°$, is about 2 candelas, $\beta=10°$, is about 4 candelas, $\beta=5°$, is about 6 candelas, $\beta=2.5°$, is about 13 candelas, and in the reflector axis 14, where $\beta=0°$, is actually about 20 candelas.

The increase of the light intensity from outer viewing directions to the viewing direction exactly on the reflector axis 14 is enormous and effects a substantially uniform visibility of the lighting fixture 18 at different distances from the lighting fixture 18 that are to be considered in this connection.

Figure 3:
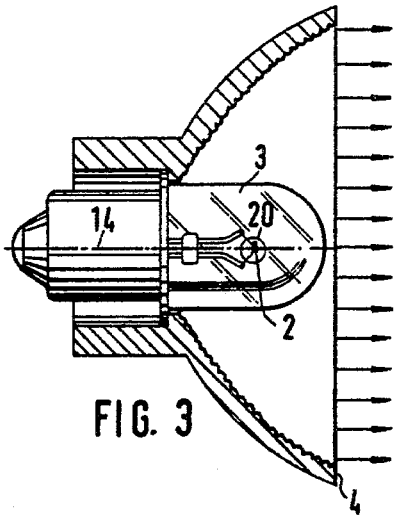
FIG. 3 is a longitudinal sectional view of a lighting fixture according to the invention.
Figure 5:
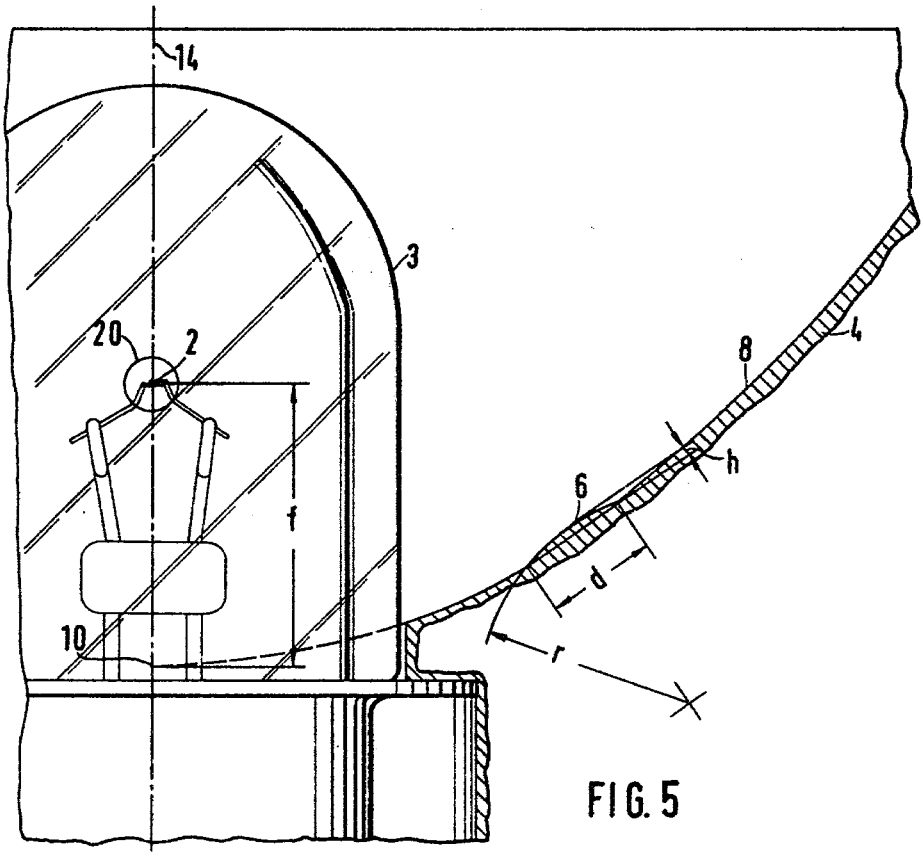
FIG. 5 is an enlarged fragmentary view of FIG. 3 showing a detail thereof rotated through 90°.

In FIG. 3, the lighting fixture according to the invention is shown schematically in a longitudinal sectional view. FIG. 5 shows an enlarged detail of the same lighting fixture shown in FIG. 3.

In the focal space 20 of the peened parabolic concave reflector 4, a luminous body 2 is disposed inside the incandescent lamp 3.

Figure 4:
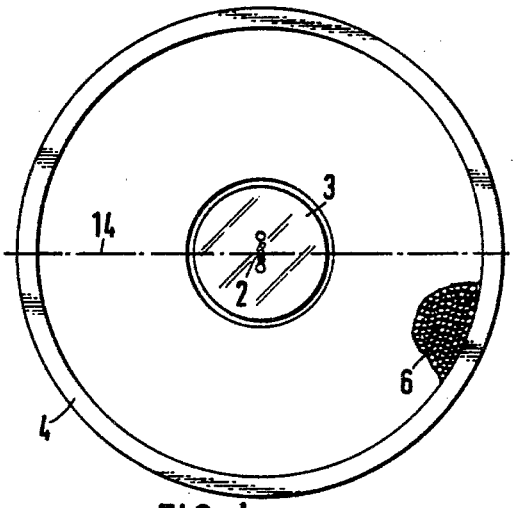
FIG. 4 is an end view of the lighting fixture of FIG. 3 as seen from the right-hand side of the latter figure.

The inner surface 8 of the reflector 4 is formed with reflecting peenings or curved surface portions 6, which are shown only schematically in FIGS. 3 and 4 (on only a fragmentary portion of the reflector surface). Fig. 5, on the other hand, shows, in greatly enlarged view, one reflecting curved surface portion or convexity 6 in the otherwise undisturbed paraboloidal surface 8 of the reflector 4.

Figure 6:
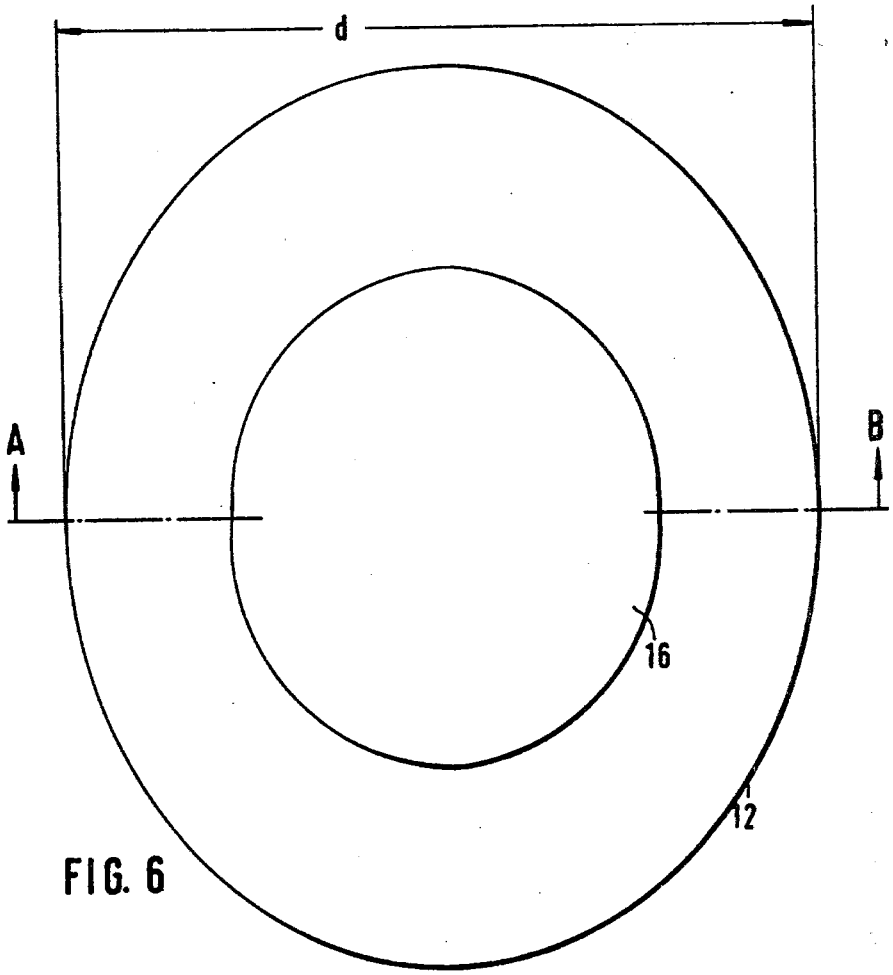
FIG. 6 is a plan view of an elliptical peening or buckling.
Figure 7:
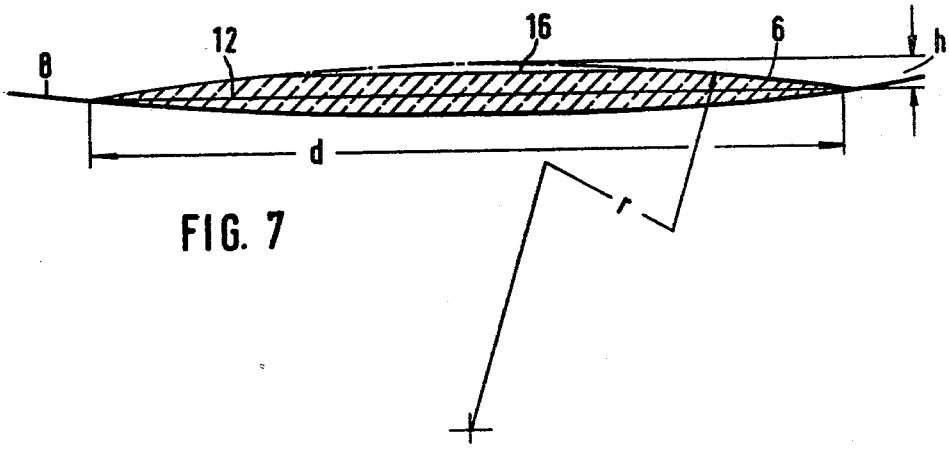
FIG. 7 is a cross sectional view of FIG. 6 taken along the line A–B in the direction of the arrows.

In FIGS. 6 and 7, one reflecting curved surface portion or convexity 6 is shown, having an area constituting a section of an ellipsoid. The base area of this reflecting convexity 6 is obtained mathematically by the intersection of this ellipsoid with the paraboloidal surface of the parabolic reflector 4. Within the limits of the tolerances that are of interest, this intersection is an ellipse and, as such, is shown in FIG. 6 as a plan view of the reflecting curved surface portion or convexity 6.

The elliptic base area 12 of the reflecting convexity 6 shown in FIGS. 6 and 7 has a minor diameter d. It also has a major diameter which is of no interest with respect to the invention of the instant application. As can be seen in FIG. 5 and particularly in FIG. 7, the reflecting convexity 6, furthermore, has the height h. This is the distance of the highest point of the reflecting convexity 6 from the base surface 12 and is from 3 to 12%, advantageously, 3.5 to 8% and preferably 4 to 6% of the minor base diameter d.

According to FIG. 7, the upper region of the reflecting convexity 6 is cut off, so that this reflecting curved surface portion 6 has a surface region 16 which is parallel to the base area 12 thereof, in order to increase the light intensity in the direction of the reflector axis 14. This planar reflecting surface region 16 is shown in plan view as an ellipse in FIG. 6. The height h indicated for this embodiment of FIGS. 6 and 7 is the original height of the reflecting convexity 6, measured without taking the cut-off part of the convexity 6, that would otherwise have been located on the planar surface area 16, into consideration.

In FIG. 7, the radius of curvature r of the surface of the reflecting convexity 6 is also noted; this radius of curvature r is, strictly speaking, constant over the entire surface of the reflecting convexity 6 only if the latter is constructed as a spherical calotte or cap-shaped member, and hence deviating from the embodiment of FIG. 7.

The reflecting convexities or curved surface portions shown are depicted as prominences or bumps or positive reflecting curvatures, so to speak. Similarly, "negative reflecting curvatures" or concavities could be used instead of or in addition to the bumps or convexities. The depth of such a depression would then be the dimension corresponding to the "height of the reflecting convexity or curvature."

In the embodiment shown in FIGS. 6 and 7, the height h of the reflecting convexity or curvature is equal to 4% of the minor base diameter d of the reflecting convexity or curvature shown; this percentage value lies well within optimal limits of 3% to 12%, according to the invention.

In FIG. 5, there can also be seen the distance f of the apex 10 of the parabolic reflector 4 from the center of the focal space or region 20 thereof. The minimal base diameter of the reflecting curvature 6 is 37% of the distance f and is therefore within a maximal limit of 40% in accordance with the invention.

The radius of curvature r of the reflecting convexity 6 is 75% of the distance f in the embodiment of FIGS. 6 and 7, which is well within the maximal limit of 80% in accordance with the invention.

Figure 8:
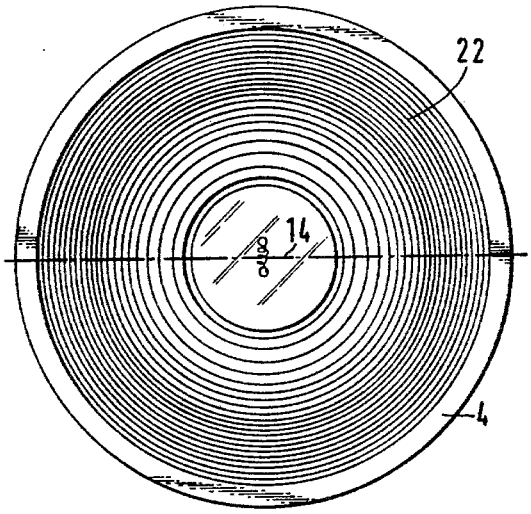
FIG. 8 is a view corresponding to that of FIG. 4, of another embodiment of the lighting fixture provided with annular reflecting, peenings or bucklings.

From a manufacturing point of view, it is simpler in some cases to make the reflecting convexities, in accordance with the embodiment of FIG. 8, as reflecting rings 22 which concentrically or coaxially surround the axis 14 of the concave reflector 4. The reflecting convexity 6 shown in FIG. 5 can be thought of as a radial cross section of such a reflecting ring; it is noted that in such a case, the "base diameter d of the reflecting convexity or curvature" is equal to the width of the reflecting ring, and the height h of the reflecting convexity or curvature is equal to the height of the reflecting ring 22. The reflecting ring is advantageously constructed as a toroidal surface.

According to FIGS. 5 and 7, the reflecting convexities or curvatures project from the otherwise undisturbed paraboloidal surface 8 of the reflector 4. The ratio between the sum of the base areas 12 of the reflecting convexities or curvatures 6 to the remaining, undisturbed paraboloidal surface 8 determines, in substance, the intensity of the light beam in the vicinity of the reflector axis 14; this part of the light beam can be increased additionally by the flat surface regions 16 which are parallel to the base area 12. A reinforcement or amplification of this part of the light beam can also be attained by the fact that, between the reflecting rings 22, more-or-less wide regions of undisturbed surface remain and/or that the reflecting rings 22 are interrupted by undisturbed surface regions.

Figure 9:
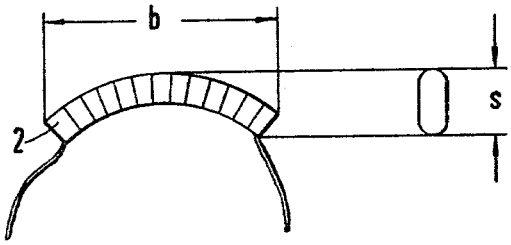
FIGS. 9 and 10 are enlarged fragmentary views of two different embodiments of the luminous body of the lighting fixture.
Figure 10:
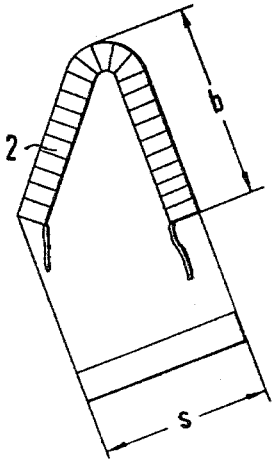

FIGS. 9 and 10 show two embodiments of an individually or singly coiled luminous body 2. The maximal spacing between two points of the luminous region of the luminous body 2 is b. A connecting line between the two points of the luminous i.e. effective, section of the luminous body 2 is designated as the "direction of maximal extension b". This maximal extension b should be at least 200 percent, preferably at least 300 percent and most preferably at least 500 percent of the average heights h of all the reflecting peenings or bucklings or, even better, of each of the heights h of every single reflecting peening or buckling. One may imagine a plane perpendicular to this "direction of maximal extension b", and the luminous body 2 projected on this plane. In simple cases, a figure with an approximately rectangular outline is obtained as the projection and, in the right-hand part of FIG. 9, this outline is folded back into the plane of the drawing. According to the invention, the maximal extension s of this outline is at least 25% of the height h of the reflecting convexity or curvature 6 or of the average value of the height h of all reflecting convexities or curvatures 6.

In addition to lighting fixtures for traffic purposes, it is believed to be readily apparent that they can also be used for stationary warning devices such as to mark obstructions and road construction sites.

Figure 11:
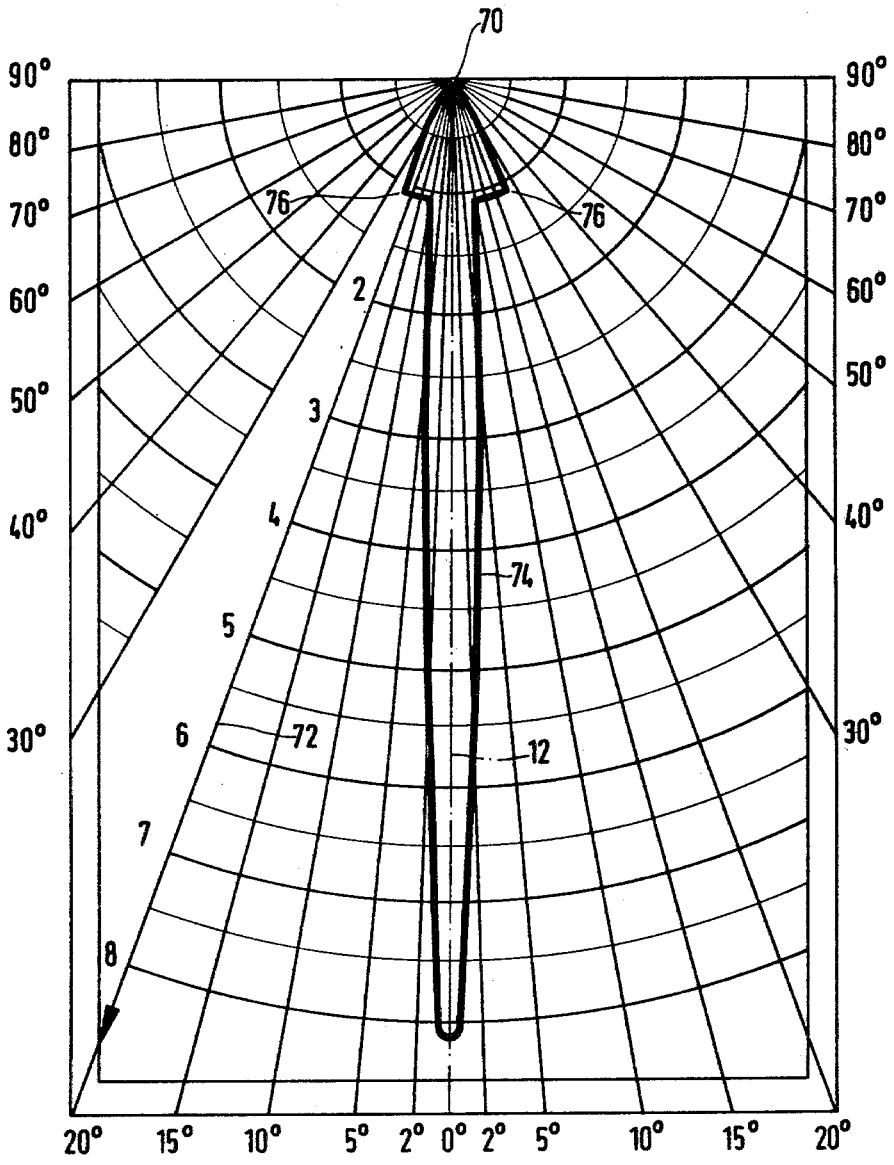
FIG. 11 is a plot diagram of a light distribution curve for an embodiment of a lamp or flashlight constructed in accordance with my improved invention, light intensities being plotted therein against the angles thereof to the axis of the lamp or flashlight.

Referring now to the improved invention of this application and particularly to FIG. 11 of the drawings, there is shown a light distribution curve 74 of light intensities 72 shown in dependence upon the angle thereof to the axis 112 of the lamp according to the invention, an embodiment of which is illustrated in FIG. 12. As shown in the plot diagram of FIG. 11, the lamp is represented to be at the point and radiates light in direction of the axis 112 thereof corresponding to 0° on the abscissa of the illustrated coordinate system. This light distribution curve 74 was plotted for the light source 60 located in the focal region F2 of FIG. 12. A bulging of the light intensities 72 is formed in the light distribution curve 74 at the region 76, this bulging being produced by the light beam 114 of the main reflector 110 and affording good illumination of the marginal zones of the combined conical light beam 114, 116. If the lamp according to the invention is used as a signal lamp, the bulge in the light intensities 72 at the regions 76 thus formed by the annular light beam 114 considerably improves lateral visibility of such a signal lamp.

FIG. 12, as aforementioned, shows the lamp which emits the light in accordance with the light distribution curve 74 of FIG. 11. The luminous body 60 of the incandescent lamp 61 is located in the focal region F2 of an assistant or supplementary reflector 130. Light rays emanating from the luminous body 60 and falling on the reflecting surface of the assistant reflector 130 are collected by the latter, with the aid of protuberances 142 formed in the reflecting surface thereof, into a conical beam having an aperture angle Ω1. The light within this conical beam 116 having the aperture angle Ω1 is advantageously distributed so that the light intensity of this beam 116 increases from the marginal region to the axis 112 thereof. The main reflector 110 of the lamp or flashlight simultaneously emits and annular hollow conical beam 114 having an aperture angle Ω2 when the light source 60 is disposed in the focal region F2.

The conical beam 116 of the assistant reflector 130 should illuminate the dark middle zone of the annular hollow conical light beam 114 of the main reflector 110. Viewed outwardly from the axis 112, there is first the light beam 116 to which the annular conical light beam 114 can be seamlessly connected. The lamp according to the invention can also be constructed so that the marginal zones of the conical light beam 116 overlap the annular hollow conical light beam 114. Since the light beams 114 and 116, in any event, however, derive from various diameter regions of the hollow reflecting mirrors 110 and 1130, a certain overlapping effect, depending upon the distance of the illuminated surface or object therefrom, will always occur anyway.

The lamp has a light aperture 122, the main reflector 110 has a focal region F1, and the assistant or supplementary reflector 130 borders on the main reflector 110 along a separating plane T. An incandescent lamp 61 is shown screwed into a lamp holder or socket 66 in FIG. 12 and projects through a central opening 131 into the lamp. The lamp has a central axis 112, and is provided with a cover plate 50 in front of the light aperture 122.

Figure 13:
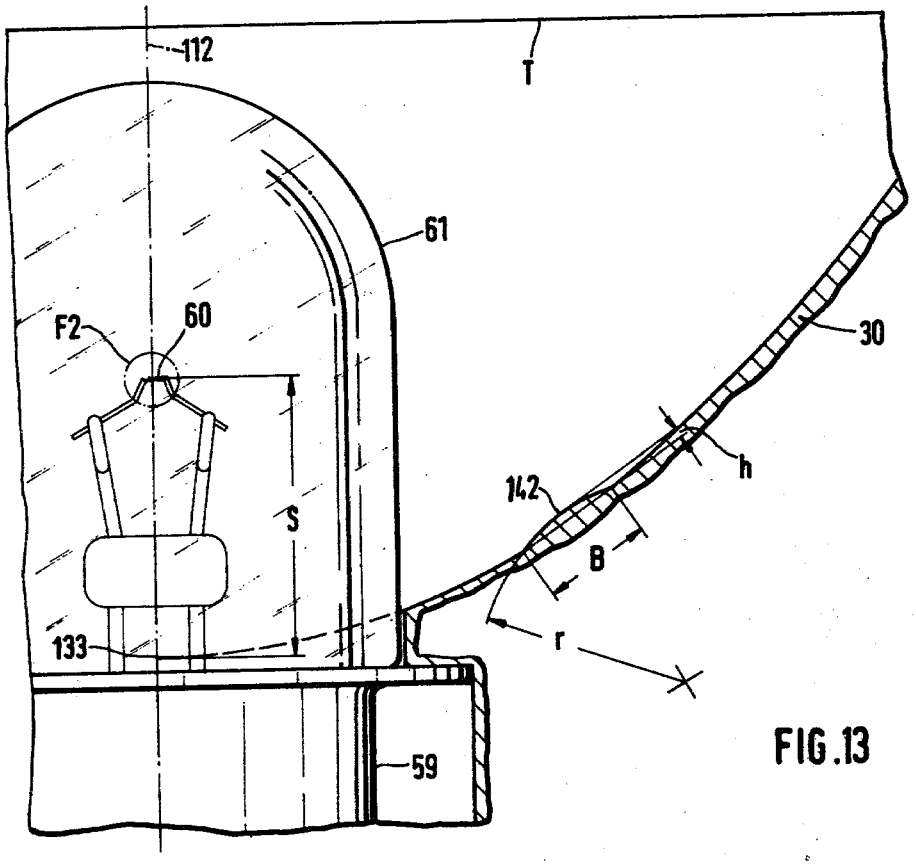
FIG. 13 is a fragmentary enlarged view of FIG. 12 showing a so-called assistant or supplementary reflector below a parting or dividing line of the lamp.

FIG. 13 shows part of a lamp constructed in accordance with the invention, namely the part with the assistant reflector 130 located below the separating plane T, as seen in the figure. To provide a better understanding of the construction of the lamp according to the invention, one of the protuberances 142 is shown in enlargement in FIG. 13, and the smallest base diameter B and the height h as well as the curvature radius r thereof are also indicated. The light source 60 is disposed in the focal region F2 of the assistant or supplementary reflector 130. The center of the focal region F2 of the assistant reflector 130 is spaced a distance S from the a½ex 133 of the parabolic assistant reflector 30. The incandescent lamp shown in FIG. 13 has a flange base or cap 59.

Figure 14:
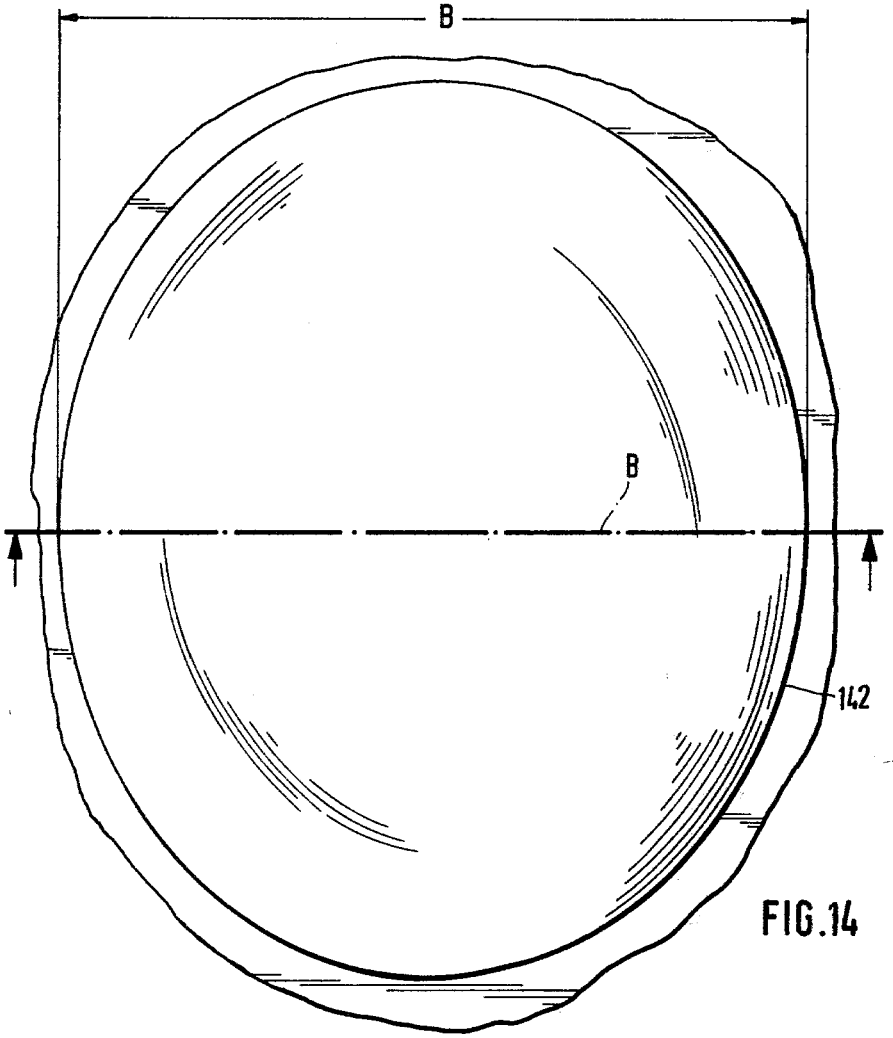
FIG. 14 is a fragmentary top plan view of FIG. 13 showing one of the curved surface portions of the assistant reflector.

FIG. 14 illustrates one of the protuberances 142 in a greatly enlarged view, the smallest base diameter B thereof being readily apparent.

Figure 15:
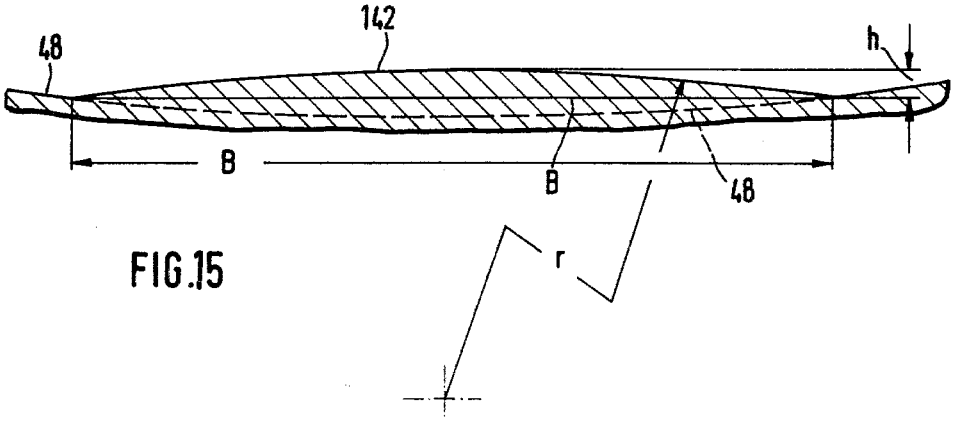
FIG. 15 is a cross-sectional view of FIG. 14 taken along the smallest base diameter B thereof.

In FIG. 15 there is shown a cross-sectional view of the protuberance 142 of FIG. 14 taken along the smallest base diameter B thereof. The original parabolic surface 48 of the assistant reflector 130 is indicated in FIG. 15. The protuberance 142 rises to a height h above the smallest base diameter B thereof. The radius of curvature r of the protuberance 142 is also indicated in FIG. 15.

The assistant reflectors 130 are advantageously constructed so that the parabolic reflecting surface thereof is provided with protuberances 142 (bulges and/or depressions), the mean height h of all of the protuberances 142 being from 3% to 20%, advantageously from 3.5% to 12% and preferably from 4% to 8% of the mean smallest base diameter B of all of the protuberances 142, and the greatest spacing between two points of the light source being at least twice as large, advantageously at least three times as large and preferably at least five times as large as the mean height h of all of the protuberances 142. Through the cooperation of a luminous body of defined dimensions with the protuberances 142, the dimensions of which have the foregoing relationship with the dimensions of the luminous body, a conical light beam is formed which, to an observer, increases in light intensity from the margin thereof toward the axis thereof.

The protuberance 142 shown in FIGS. 14 and 15 is not round. It could, however, also be round, just as well. In the cases wherein protuberances 142 (FIG. 25) are provided in the form of rings around the hollow mirror axis 112, the smallest diameter B of the respective protuberance 141 is equal to the width of the respective ring. If calculations are made with the mean values of the height h and the smalles base diameter B of all of the protuberances 142, this then confines the possibility of individual sharp deviations from these mean values. The smaller the deviations from the mean values, the better is the light distribution that is attained.

The best results are obtained if the height h substantially of each individual protuberance is from 3% to 20%, advantageously 3.5% to 12% and preferably 4% to 8% of the smallest base diameter B thereof. It is furthermore advantageous if the greatest extension of the projection of the luminous body on a plane perpendicular to the direction of the greatest extension thereof is at least 25% of the mean height H of all of the protuberances 142 or rings 141, and advantageously of the height h of each individual protuberance 141 or 142. An especially favorable light distribution, for an observer, in all lines of sight or viewing directions (lying in the illuminated aperture angle) is produced if the mean smallest base diameter B of all the protuberances 142, and advantageously the smallest base diameter B of each individual protuberance is 5% to 40%, advantageously 7% to 30% and preferably 9% to 25% of the spacing of the apex of the parabolic hollow mirror reflector from the focal point thereof or from the middle of the focal region thereof.

Good results are attained if the surfaces of the protuberances 142 are formed as spherical calottes advantageously having a radius of curvature r between 10% and 70%, preferably between 15% and 50%, of the spacing of the middle of the focal region from the apex of the assistant reflector 130. In FIGS. 12, 13, 19, 20, 21, 22, 23, 24 and 25, the assistant concave reflector 130 is generally parabolic if the small deviations due to the protuberances are ignored.

To control the light distribution, it an be advantageous if the surfaces of the protuberances are cutaway portions or sections of ellipsoids or ellipsoidal surfaces, and the plan view of the base of the protuberances is elongated, advantageously elliptical or nearly or somewhat elliptical.

In an advantageous embodiment, as aforementioned, the protuberances can be constructed in the form of rings coaxially or concentrically surrounding the axis of the hollow mirror reflector, the surfaces of the rings being advantageously cutaway portions or sections of toroidal surfaces. Also as noted hereinafter, the smallest base diameter of a respective ring-shaped protuberance 141 corresponds to the width of one of the rings. Such ring-shaped protuberances are shown in FIG. 25.

The surface structure of the protuberances 142 should be as smooth as possible, because no diffused light but rather a conical light beam with quite specific aperture angles is supposed to be produced.

Figure 16:
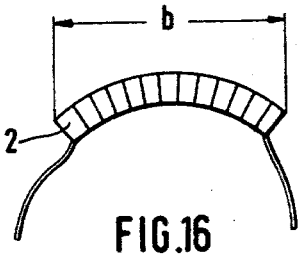
FIG. 16 is an enlarged fragmentary view of FIG. 12 showing the coiled luminous body thereof as constructed in accordance with the invention.

FIG. 16 shows a coiled luminous body of an incandescent lamp. The greatest distance between two points of this luminous body is indicated by the measurement b. This greatest spacing b between two points of the light source should be at least twice as large as the mean height h of all of the protuberances 141 or 142.

Figure 17:
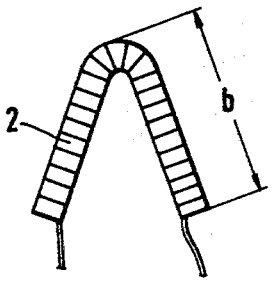
FIG. 17 is a view similar to that of FIG. 16 of another embodiment of the luminous body.

FIG. 17 shows a differently shaped luminous body than that in FIG. 16. Also in FIG. 17, the greatest distance between two points of the luminous body 2 is indicated by the measurement b. In FIG. 7, as well, the greatest spacing between two points of the luminous body should be at least twice as large as the mean height h of all of the protuberances 141 or 142.

FIG. 18 shows a lamp similar to that in FIG. 12 with the difference, however, that both the main concave reflector 110 and the assistant concave reflector 130 have a reflecting surface that is formed without any bulges and/or depressions. For that reason, light-bending or diverting means are provided in a ring-shaped region 54 of the cover plate 50 which is impinged upon by parallel-directed light rays from the assistant reflector 130, so as to divert the axial parallelism of these light rays into a conical light beam with an aperture angle of, for example 40%, in order to supplement, radially inwardly, the ring-shaped conical light beam 114 produced by the main reflector 110 or, if desired, also to overlap the light beam 114. In the case at hand, the light-diverting or bending means, which are located in the region 54, are made up of flutes incised or formed in the cover plate 50 and encircling the axis 112, the flutes having flanks 132 that are so inclined as to break the light into the desired aperture angle.

If it is desired to receive specially great light intensities in axial direction, the bottoms or the points of these flutes can be made plano parallel so that the light does not experience any change in direction thereat. This is shown in FIG. 18*a*. FIG. 18*b* shows a different type of the flutes 136 having a round or, preferably, also a parabolic cross section in order thus to form the light distribution homogeneously within the light beam 116. Naturally, other light-diverting means, such as circular ring-shaped lenses, for example, can also be used for diverting or bending the light into the desired aperture angle in the region 54.

FIG. 19 shows the same lamp as in FIG. 2 with the difference, however, that the main reflector 110 and the auxiliary reflector 130 have been so shifted with respect to the light source 60 in direction of the lamp axis 112 that the light source 60 is no longer located in the focal region F1 of the main reflector 110. In this location of the light source, a narrow, substantially parallel light beam 113 is produced by the smooth reflecting surface of the main reflector 110. The reflecting surface of the main reflector 110 could also be equipped with very slight bulges and/or depressions for homogenizing the substantially parallel bright light beam. The main reflector 110 terminates at the plane T at which it borders on or abuts the assistant reflector 130 having the focal region F2. Advantageously, both hollow mirror reflectors 110 and 130 are formed of one piece. Both hollow mirror reflectors 110 and 130 have the same lamp axis 112. In vicinity of the apex of the assistant reflector 130 is an opening 131 through which the light source, such as the luminous body of an incandescent lamp, for example, projects into the reflectors 130 and 110.

The holder or mounting support for the hollow mirror reflectors 130 and 110, on the one hand, and the light source 60, on the other hand, should be so constructed that the light source 60, and the reflectors 130 and 110 can be shifted or adjusted relative to one another in axial direction so that the light source 60 can be brought selectively into the focal region F1 or into the focal region F2. In FIG. 19, the light source 60 of the incandescent lamp 61 is located in the focal region F1 of the main reflector 110 which emits the parallel light beam 113 in this setting. In practice, not all of the light rays are exactly parallel because the luminous body 60 of the incandescent lamp 61 is not ideally punctiform and also the reflector 110 can obviously be produced only nearly but not mathematically exactly. Due to these slight deviations, the light beam 113 is, indeed, substantially parallel at a given short distance from and in from of the lamp, yet, however, is already so well intermixed that it appears to the viewer as a closed parallel light beam.

FIG. 20 shows an embodiment of a lamp according to the invention which is similar to that of FIGS. 12 and 19, but which has been provided additionally for explaining the angle of light acceptance. A plane SF1 perpendicular to the axis 112 is disposed through the focal region F1 of the main reflector 110. This plane SF1 and a straight line 128 intersecting therewith and passing through the focal region F1 and through the outer edge 123 of the main reflector 110 include an angle $\alpha 1$ of about 31°. Furthermore, this plane SF1, with a straight line 129, which extends through the focal region F1 and the inner edge 126 of the main reflector 110, includes an angle $\beta 1$ of about 21°. Altogether, light beams emitted from the focal region F1 are held by the main reflector 110 within the range of an angle $\alpha 1+\beta 1=52°$.

A plane SF2 perpendicular to the axis 112 is disposed through the focal region F2. This plane SF2, with a straight line 120 which extends through the focal region F2 and the outer edge 126 of the assistant reflector 130 includes an angle $\alpha 2$ or about 5°. The light-acceptance angle of the assistant reflector 130 is limited by a straight line 121 below the plane SF2, as viewed in FIG. 20, the straight line 121 extending through the inner edge 118 of the assistant reflector 130 at the inlet opening 131 for the incandescent lamp. The angle $\beta 2$ between the plane SF2 and the straight line 121 is about 33° in the case at hand. Altogether, if the light source is located in the focal region F2, light is thus held by the assistant reflector 130 in an angle range $\alpha 2+\beta 2=38°$.

The spacing of both focal regions F1 and F2 from one another is about 30% of the parameter of the main reflector 110. The parameter of a parabola is twice as large as the spacing of the focal point of the parabola from the apex of the parabola. The focal region F1 is surrounded by the main reflector 110, and the focal region F2 by the assistant reflector 130. The parameter of the assistant reflector 130 is, in this case, 68% of the parameter of the main reflector 110.

FIG. 21 shows a hollow mirror reflector having a main reflector 110 with a greater parameter than that of the assistant reflector 130 thereof. The focal region of the main reflector 110 is located at F1, whereas the focal region of the assistant reflector 130 is at F2. If the light source is disposed in the focal region F1, the main reflector 110 than emits nearly parallel light. If the light source is then brought into the focal region F2 of the assistant reflector 130, the hollow mirror reflector 110 then produces a ring-shaped conical light beam which is illuminated in the inner region thereof by a conical light beam of the assistant reflector 130. This conical light beam brightens or illuminates the aperture angle thereof due to the protuberances 142 provided on the surface of the assistant reflector 130.

In the embodiment of the invention shown in FIG. 21, the main reflector 110 could naturally, also be extended to the light outlet opening 122, as presently illustrated in the figure, and the assistant reflector 130 with the protuberances 142 thereof could then be disposed beyond or forward of the presently shown light outlet opening 122 located at the end of the thus elongated main reflector 110.

FIG. 22 shows an embodiment of a lamp similar to that shown in FIGS. 12, 19 and 20. If the light source is brought toward the focal region F2, a surprising observation is made that most of the light rays that are collected by the main reflector 110 emerge through a relatively narrow ring-shaped region 52 of the cover plate 50. In order to homogenize somewhat this narrow ring-shaped region of the hollow conical light beam 114, ring-shaped flutes encircling the axis 112 are provided in the cover plate 50 at the region 52. In FIG. 22*a*, such flutes 53 are shown in an enlarged view for a better understanding of the construction thereof. It has been found to be sufficient if these flutes 53 form with the flanks 55 and 56 thereof an angle of only 3° to 20°, and preferably of 5° to 12°, with the plane of the cover plate 50. Advantageously, these or other light distributing means are provided in this region 52 at the inner side of the cover plate 50 so that they do not become filled with dust. If the light source is then brought toward to focal point F1 of the main reflector 110, the parallelism of the light beam then becomes impaired somewhat (homogenized) only in the small ring-shaped region of the flutes at 52, whereas the light rays in the entire remaining region of the cover plate 50 can emerge undisturbed in parallel. Through the small region 52 provided with only limited light-distributing means, only a given homogenization of a small part of the parallel rays occurs in the bright light beam, which has barely any negative effect upon the range of the parallel light beam yet gives the light beam a greater uniformity.

FIG. 23 shows a lamp similar to the lamps shown in FIGS. 12, 19 and 20, yet with the difference that, in FIG. 23, the main reflector 110 is provided with quite weakly punched out or embossed bulges and/or depressions, such as protuberances 43, for example. These do not have the function of distributing the light over a large angle range, but rather, because of the very weak optical efficiency thereof, serve only for homogenizing the parallel light beam when the light source is set in the focal region F1. Obviously, if the light source is brought toward the focal region F2, the ring-shaped hollow conical light beam 114, which then emerges from the main reflector 110, is thereby also homogenized.

FIG. 24 illustrates an embodiment of a lamp according to the invention which is similar to the embodiment in FIG. 22. A collecting or condenser lens 62 is disposed, in this case, in front of the light source 60. If the light source 60 of the lensed incandescent lamp 64 is set in the focal region F2 of the assistant reflector 130, the main reflector 110 then delivers a light ring which is filled out by the conical light beam that is collected by the assistant reflector 130 and fanned out due to the light distributing protuberances 142. The light rays whch would otherwise emerge ineffectually, without beaming, through the light outlet opening 122 of the main reflector 110, are thus formed into a beam by the collecting lens 62 and overlaps both light beams thrown by the hollow mirror reflectors 110 and 130. An especially good homogenization and reinforcement of the illumination in these combined light beams is thereby attained. The socket or receptacle 66 into which the lensed incandescent lamp 64 is screwed, tapers or narrows down in a part 68 thereof so that the assistant reflector 130 can slide with the opening 131 thereof over this socket part 68, when the light source 60 is shifted into the focal region F1, if the main reflector 110 is supposed to produce a parallel light beam.

FIG. 25 shows a lamp similar to that in FIG. 22 but wherein the assistant reflector is furnished, however, with protuberant rings 41 running around the axis 112 instead of with dome and/or cup-shaped protuberances 142.

I claim:

1. Lamp having a main concave and an assistant concave reflector disposed mutually coaxially and having different parameters and focal regions, the different focal regions being disposed in the common axis of the reflectors and spaced from one another, the lamp comprising a light source disposed in the focal region of the assistant reflector so that the main reflector emits a hollow conical light beam, the assistant reflector having a reflective surface formed with a multiplicity of reflecting curved surface portions, the mean height of all thereof being equal to from 3% to 12% of the mean smallest base diameter of all of said reflecting curved surface portions for diverting light from the assistant reflector into a solidly conical light beam.

2. Lamp according to claim 1 wherein said aperture angles of said light beams are between 20° and 90°.

3. Lamp according to claim 1 wherein the main reflector and the assistant reflector are paraboloids, the main reflector having a greater parameter than that of the assistant reflector.

4. Lamp according to claim 1 wherein the coaxial reflectors have a light outlet opening, the main reflector of the two reflectors being adjacent said light outlet opening.

5. Lamp according to claim 1 wherein the main reflector and the assistant reflector are paraboloids, the main reflector having a greater parameter than that of the assistant reflector, the smaller assistant-reflector parameter being from 55% to 80% of the greater main-reflector parameter.

6. Lamp according to claim 1 wherein the main reflector and the assistant reflector are paraboloids, the main reflector having a greater parameter than that of the assistant reflector, and the spacing between both focal regions being 20% to 60% of the greater parameter.

7. Lamp according to claim 1 wherein each of the focal regions is disposed in a surrounding space of the respective reflector associated therewith.

8. Lamp according to claim 1 wherein a plane disposed through the focal region of the main reflector and perpendicularly to the lamp axis divides an angle stretching from the focal region of the main reflector to an outer and an inner edge of the main reflector so as to form an outer angle of at least 18°, and an inner angle of at least 10°.

9. Lamp according to claim 1 wherein a plane disposed through the focal region of the assistant reflector and perpendicularly to the lamp axis divides an angle stretching from the focal region of the assistant reflector to an outer and an inner edge of the assistant reflector so as to form an outer angle of at least 0°, and an inner angle of at least 18°.

10. Lamp according to claim 1 wherein an outer edge of the assistant reflector and an inner edge of the main reflector are closely adjacent one another.

11. Lamp according to claim 1 wherein an outer edge of the assistant reflector and an inner edge of the main reflector substantially coincide one with the other.

12. Lamp according to claim 1 wherein said reflecting curved surface portions are in the form of calottes and have a height which is 3.5% to 12% of the smallest base diameter thereof.

13. Lamp according to claim 1 wherein said reflecting curved surface portions are in the form of rings and have a height which is 3.5% to 12% of the width of a respective ring.

14. Lamp according to claim 1 including means for homogenizing light associated with the main reflector.

15. Lamp according to claim 14 wherein said light source is disposed in the focal point of the assistant reflector, and said light-homogenizing means comprise flutes formed in a ring-shaped region of a cover plate located at a light outlet end of the reflectors, said ring-shaped region forming an outlet for light reflected from the main reflector in the shape of a conical ring-shaped light beam.

16. Lamp according to claim 15 wherein said flutes have a respective cross section in the form of an obtuse triangle having legs forming flanks of the respective flute, said legs including, with the surface of said cover plate, a flank angle of 3° to 20°.

17. Lamp according to claim 14 wherein said light homogenizing means comprise protuberances disposed on the reflecting surface of the main reflector and having a very large radius of curvature.

18. Lamp according to claim 1 including a collecting lens disposed in axial direction of the lamp in front of said light source for capturing and collecting light rays emitted from said light source and emerging directly in direction of a light outlet opening of the lamp and superimposing the thus collected light rays on a light beam collected and united by the main and the assistant reflectors.

19. Lamp according to claim 18 wherein said collecting lens is constructed as a collecting lens of a lensend incandescent lamp.

20. Lamp according to claim 1 wherein both the main and the assistant reflector are integral with one another.

21. Lamp according to claim 1 having a light intensity increasing with decreasing distance from the lamp axis so that part of the light beam which includes, with the lamp axis, an angle of 2°, has at least 2.1 times the light intensity of a part of the light beam which includes, with the lamp axis, an angle of 15°.

22. Lamp according to claim 1 having a light intensity increasing with decreasing distance from the lamp axis so that part of the light beam which includes, with the lamp axis, an angle of 5°, has at least 1.8 times the light intensity of a part of the light beam which includes with the lamp axis, an angle of 15°.

23. Lamp according to claim 1 having a light intensity increasing with decreasing distance from the lamp axis so that part of the light beam which includes, with the lamp axis, an angle of 2°, has at least four times the light intensity of a part of the light beam which includes, with the lamp axis, an angle of 15°.

24. Lamp according to claim 1 having a light intensity increasing with decreasing distance from the lamp axis so that part of the light beam which includes, with the lamp axis, an angle of 5°, has at least twice the light intensity of a part of the light beam which includes, with the lamp axis, an angle of 15°.

25. Lamp having a transparent cover plate and a main concave and an assistant concave reflector disposed mutually coaxially and having different parameters and focal regions, the different focal regions being located in the common axis of the cover plate and the reflectors and being spaced from one another, the lamp comprising a light source disposed in the focal region of the assistant reflector so that the main reflector emits a hollow conical light beam and the assistant reflector a solid conical light beam, the transparent cover plate being formed with light diverting flutes at a region thereof through which said light beam of the assistant reflector passes, said flutes enlarging the aperture angle of said solid conical light beam of the assistant reflector.

26. Lamp according to claim 1 wherein the reflectors are adjustably shiftable in axial direction so that said light source is disposable at respective locations selectively in one of and between said focal regions.

27. Lamp according to claim 1 wherein said light source is adjustably shiftable in axial direction so that said light source is disposable at respective locations selectively in one of and between said focal regions.

28. Lamp according to claim 1 wherein said light source and the reflectors are adjustably shiftable in axial direction relative to one another so that said light source is disposable at respective locations selectively in one of and between said focal regions.

29. Lamp according to claim 1 wherein the main reflector and the assistant reflector are paraboloids the main reflector having a greater parameter than that of the assistant reflector, and the spacing between both focal regions is 25% to 40% of the greater parameter.

30. Lamp according to claim 1 wherein a plane disposed through the focal region of the main reflector and perpendicularly to the lamp axis divides an angle stretching from the focal region of the main reflector to an outer and an inner edge of the main reflector so as to form an outer angle of at least 25°, and an inner angle of at least 15°.

31. Lamp according to claim 1 wherein a plane disposed through the focal region of the assistant reflector and perpendicularly to the lamp axis forms an angle of at least 25° stretching from the focal region of the assistant reflector to an inner edge of the assistant reflector.

32. Lamp according to claim 25 wherein the reflectors are adjustably shiftable in axial direction so that said light source is disposable at respective locations selected in one of and between said focal regions.

33. Lamp according to claim 25 wherein said light source is adjustably shiftable in axial direction so that said light source is disposable at respective locations selectively in one of and between said focal regions.

34. Lamp according to claim 25 wherein said light source and the reflectors are adjustably shiftable in axial direction relative to one another so that said light source is disposable at respective locations selectively in one of and between said focal regions.

35. Lamp according to claim 25 wherein said aperture angles of said light beams are between 20° and 90°.

36. Lamp according to claim 25 wherein the main reflector and the assistant reflector are paraboloids, the main reflector having a greater parameter than that of the assistant reflector.

37. Lamp according to claim 25 wherein the main reflector and the assistant reflector are paraboloids, the main reflector having a greater parameter than that of the assistant reflector, the smaller assistant—reflector parameter being from 55% to 80% of the greater main-reflector parameter.

38. Lamp according to claim 25 wherein the main reflector and the assistant reflector are paraboloids, the main reflector having a greater parameter than that of the assistant reflector, and the spacing between both focal regions being 20% to 60% of the greater parameter.

39. Lamp according to claim 25 wherein a plane disposed through the focal region of the main reflector and perpendicularly to the lamp axis divides an angle stretching from the focal region of the main reflector to an outer and an inner edge of the main reflector so as to form an outer angle of at least 18° and an inner angle of at least 10°.

40. Lamp according to claim 25 wherein a plane disposed through the focal region of the assistant reflector and perpendicularly to the lamp axis forms an angle of at least 25° stretching from the focal region of the assistant reflector to an inner edge of the assistant reflector.

41. Lamp having a main concave and an assistant concave reflector disposed mutually coaxially and having different parameters and focal regions, the different focal regions being located in the common axis of the reflectors and being spaced from one another, the lamp comprising a light source disposed in the focal region of the assistant reflector so that the main reflector emits a hollow conical light beam, and means associated with the assistant reflector for diverting light of the assistant reflector into a solidly conical light beam, the solidly conical light beam of the assistant reflector and the hollow conical light beam of the main reflector having aperture angles corresponding to an extent that both said hollow and solidly conical light beams exhibit at least one of the characteristics of supplementing and overlapping one another.

42. Lamp having a transparent cover plate and a main concave and an assistant concave reflector disposed mutually coaxially and having different parameters and focal regions, the different focal regions being located in the common axis of the reflectors and the cover plate and being spaced from one another, the lamp comprising a light source disposed in the focal region of the assistant reflector so that the main reflector emits a hollow conical light beam, and means associated with said cover plate for diverting light of the assistant reflector into a solidly conical light beam, the solidly conical light beam of the assistant reflector and the hollow conical light beam of the main reflector having aperture angles corresponding to an extent that both said hollow and solidly conical light beams exhibit at least one of the characteristics of supplementing and overlapping one another.

* * * * *